US006037709A

United States Patent [19]

Nakagawa et al.

[11] Patent Number: 6,037,709

[45] Date of Patent: Mar. 14, 2000

[54] CATHODE RAY TUBE

[75] Inventors: Shinichiro Nakagawa; Norio Shimizu, both of Fukaya, Japan

[73] Assignee: Kabushiki Kaisha Toshiba, Kawasaki, Japan

[21] Appl. No.: 09/075,827

[22] Filed: May 12, 1998

[30] Foreign Application Priority Data

May 12, 1997 [JP] Japan ..... 9-120926

[51] Int. Cl.[7] ..... H01J 29/07

[52] U.S. Cl. ..... 313/404; 313/407

[58] Field of Search ..... 313/402, 404, 313/405, 406, 407

[56] References Cited

U.S. PATENT DOCUMENTS

| | | | |
|---|---|---|---|
| 3,999,098 | 12/1976 | Dougherty | 313/407 |
| 4,652,792 | 3/1987 | Tokita et al. | 313/404 |
| 4,827,180 | 5/1989 | Sone et al. . | |
| 4,916,357 | 4/1990 | Nakamura et al. | 313/404 |
| 5,012,154 | 4/1991 | Ragland, Jr. | 313/406 X |
| 5,210,459 | 5/1993 | Lee | 313/402 X |
| 5,502,349 | 3/1996 | Seo | 313/407 X |

FOREIGN PATENT DOCUMENTS 0 446 792 9/1991 European Pat. Off. .

*Primary Examiner*—Ashok Patel

*Attorney, Agent, or Firm*—Pillsbury Madison & Sutro LLP

[57] ABSTRACT

A cathode ray tube includes a panel having a substantially rectangular effective surface and a substantially rectangular skirt portion standing on the periphery of the effective surface, a shadow mask having a substantially rectangular mask body and a mask frame supporting the mask body and opposed to the skirt portion, and a holder provided between the skirt portion of the panel and the mask frame of the shadow mask and elastically suspending the mask frame to the panel. The holder comprises a first member having an engagement portion engaged with a stud pin attached on the skirt portion, and a second member having a fixing portion fixed to the mask frame. The plate-thickness of the first member is smaller than that of the second member, and the length of a first slanting portion of the first member is smaller than the length of a second slanting portion of the second member. With use of this holder, a color drift caused by an external impact undesirably applied to the cathode ray tube and a color drift caused by a thermal expansion of the mask frame during operation for a long time can simultaneously be corrected and an image of excellent quality can be displayed stably.

8 Claims, 6 Drawing Sheets

CATHODE RAY TUBE

BACKGROUND OF THE INVENTION

The present invention relates to a cathode ray tube comprising a plurality of support members for suspending a mask frame on a face panel.

In general, a cathode ray tube comprises a panel having a substantially rectangular skirt portion standing on the periphery of a substantially rectangular effective surface, a funnel connected with the skirt portion of the panel, a phosphor screen formed inside an effective surface of the panel, a shadow mask having a substantially rectangular mask body where a number of electron beam apertures are formed and a substantially rectangular mask frame attached on the periphery of the mask body, a plurality of support member for elastically suspending the shadow mask on the panel such that the mask body is opposed to the phosphor screen, an electron gun provided in a neck portion of the funnel to emit an electron beam to the phosphor screen through electron beam apertures of the mask body, and a deflector for generating a magnetic field to deflect the electron beam emitted from the electron gun.

Thus, the electron beam emitted from the electron gun is deflected by the deflector and the phosphor screen is scanned in the horizontal and vertical directions through the shadow mask, thereby displaying a color image through the panel.

A holder 40 having a substantial wedge-like shape as shown in FIG. 11 is known as a support member for supporting the shadow mask. The holder 40 has a side fixed on the mask frame 42 of the shadow mask and another side detachably engaged on a stud pin provided so as to project from the skirt portion 44.

To display an image without a color drift on the phosphor screen 46, the electron beam passing through an electron beam aperture in the shadow mask must be landed correctly on a predetermined position on the phosphor screen 46. Therefore, the positional relationship between the panel and the shadow mask, and particularly, the distance between the inner surface of the panel where the phosphor screen 46 is formed and the mask body where a number of electron beam apertures 45 are formed must be maintained with high precision.

However, if the mask body is made of a thin carbon steel plate or the like, the mask body is thermally expanded by the collision of the electron beam during operation for a long time, toward the phosphor screen 46, i.e., so-called doming is caused. When the mask body thus causes doming, the distance therefrom to the inner surface of the panel is changed and the landing of the electron beam is misregistered, thereby causing a color drift in the display image.

Therefore, the color drift caused by the doming of the mask body is compensated by using the substantially wedge-like holder 40 as described above. This means that the holder 40 is deformed as indicated by a one-dot chain line in the figure when doming occurs in the mask body and the mask body is pushed up in the direction toward the phosphor screen 46. In this manner, the landing position of the electron beam is compensated so that the position is not changed before and after the thermal expansion of the shadow mask.

In addition, as for a cathode ray tube of a relatively large size, it is known to form the mask body from an invar material having a lower thermal expansion coefficient than the mask frame. Thus, in a cathode ray tube having a mask body having a lower thermal expansion coefficient than the mask frame, the holder 50 as shown in FIG. 12 is used.

The holder 50 has a first member fixed to the mask frame 52 of the shadow mask, and a second member engaged on the stud pin 53 projected from the skirt portion 54 of the panel. The holder 50 is formed to have a substantially V-shaped cross-section which is symmetrical in the lateral direction.

If this kind of cathode ray tube is operated for a long time, the mask body is little thermally expanded but only the mask frame 52 is thermally expanded as indicated by a one-dot chain line in the figure. In this time, the shadow mask is not moved in a direction in which the shadow mask is apart from and close to the phosphor screen 56 since the holder 50 is formed to be symmetrical in the lateral direction. This means that the landing position of the electron beam can be maintained at a correct position even if the mask frame is thermally expanded.

However, even if the counter measure as described above is taken, in most cases of recent cathode ray tubes having a relatively large deflection angle, a color drift caused by misregistration of the landing position of the electron beam. To compensate such electron beam landing misregistration, the mask frame 52 needs to be moved in a direction in which the frame 52 is apart from the phosphor screen 56, i.e., toward the electron gun. Specifically, to cancel heat expansion of the mask body toward the phosphor screen 56, deformation of the holder due to thermal expansion of the mask frame must cause the mask frame to move toward the electron gun.

For example, Japanese Patent Application KOKAI Publication No. 1-14851 discloses an example of a technique of moving the mask frame toward the electron gun. Disclosed in this publication is a holder having a first member which is engaged on a skirt portion of a panel and has a greater plate-thickness than a second member fixed on the mask frame. If the plate-thickness of the first member is thus thickened, the first member tends to be deformed less easily than the second member. As a result, when the mask frame is thermally expanded, the second member is more deformed than the first member, so that the mask frame is moved toward the electron gun.

However, in this holder, a stress is concentrated on the second member having a smaller thickness than the first member when an undesired impact is applied from the outside of the cathode ray tube. Consequently, the second member which is relatively weak and tends to be easily deformed is plastically deformed and misregistered landing is caused due to the deformation of the second member, if the impact from the outside cannot be absorbed.

As a technique for preventing misregistered landing due to an external impact, Japanese Patent Application KOKOKU Publication No. 64-27144 proposes a holder 40 having bending portions 40*a* and 40*b*. The bending portions 40*a* and 40*b* function to restrict a movement of the mask frame against an external impact from a direction vertical to the page surface in FIG. 11, but is not effective against an external impact from the direction of the tube axis of the cathode ray tube.

Also discussed is a method of improving the rigidity of respective components of the holder to hinder plastic deformation. However, if this method is adopted, it is not possible to correct sufficiently a color drift caused under influences from a heat when the cathode ray tube is operated for a long time, but also the detachability of the holder during manufacturing steps is degraded.

As described above, the shape of the holder holding the shadow mask is important to display an image on a phosphor screen of a cathode ray tube without a color drift. However, it is difficult for conventional techniques to provide a holder which is capable of simultaneously correcting both a color drift caused by a change of the positional relationship between the shadow mask and the panel due to an external impact and a color drift caused due to influences from a heat when the cathode ray tube is operated for a long time.

BRIEF SUMMARY OF THE INVENTION

The present invention has been made in view of the respects described above and has an object of providing a color cathode ray tube capable of simultaneously correcting a color drift caused by an external impact and a color drift caused by a thermal expansion so that an image of high quality can be stably displayed.

To achieve the above object, the cathode ray tube according to claim 1 of the present invention cathode ray tube comprises: a face panel having a substantially rectangular effective portion, a side wall portion standing along a peripheral edge portion of the effective portion, and a plurality of stud pins projected from an inner surface of the side wall portion; a phosphor screen formed on an inner surface of the effective portion of the face panel; a shadow mask having a substantially rectangular mask body and a substantially rectangular mask frame, the mask body being provided inside the face panel and having a plurality of apertures opposed to the phosphor screen, and the mask frame supporting a peripheral edge portion of the mask body and opposed to the side wall portion of the face panel; a plurality of support members fixed to the mask frame and respectively engaged with the stud pins of the face panel, thereby elastically supporting the mask frame on the face panel; an electron gun for emitting an electron beam onto the phosphor screen through the plurality of apertures of the mask body; and a deflector for deflecting the electron beam emitted from the electron gun, and is wherein each of the support members has first and second members each formed by bending a narrow long plate-like member having an elasticity, that the first member has an engagement portion engaged with the stud pin, a first connection portion connected with the second member, and a first slanting portion slanted and extended from the first connection portion toward the engagement portion, in a direction in which the first member is apart from the second member, that the second member has a fixing portion fixed to the mask frame, a second connection portion connected with the first connection portion of the first member, and a second slanting portion slanted and extended from the second connection portion toward the fixing portion, in a direction in which the second member is apart from the first member, and that the first member has a plate-thickness d1 smaller than a plate-thickness d2 of the second member, and the first slanting portion has a length L1 smaller than a length L2 of the second slanting portion.

According to claim 2 of the present invention, the cathode ray tube is wherein an angle $\theta 1$ between the first slanting portion of the first slanting portion and the engagement portion is larger than an angle $\theta 2$ between the second slanting portion of the second member and the fixing portion.

According to claim 3 of the present invention, the cathode ray tube is wherein an angle $\phi 1$ of the first slanting portion to a tube axis of the cathode ray tube is larger than an angle $\phi 2$ of the second slanting portion to the tube axis.

According to claim 4 of the present invention, the cathode ray tube is wherein the length L1 and the angle $\phi 1$ of the first slanting portion and the length L2 and the angle $\phi 2$ of the second slanting portion satisfy a relation of $L1 \times \cos\phi < L2 \times \cos\phi 2$.

According to claim 5 of the present invention, the cathode ray tube according is wherein the first connection portion of the first member is extended in a direction in which the first slanting portion is extended.

According to claim 6 of the present invention, the cathode ray tube comprises: a face panel having a substantially rectangular effective portion, a side wall portion standing along a peripheral edge portion of the effective portion, and four stud pins provided to be projected from inner surfaces of four corner portions of the side wall portion; a phosphor screen formed on an inner surface of the effective portion of the face panel; a shadow mask having a substantially rectangular mask body and a substantially rectangular mask frame, the mask body being provided inside the face panel and having a plurality of apertures opposed to the phosphor screen, and the mask frame supporting a peripheral edge portion of the mask body, being opposed to the side wall portion of the face panel, and having a higher thermal expansion coefficient than the mask body; four support members respectively fixed to four corner portions of the mask frame and respectively engaged with the four stud pins of the face panel, thereby elastically supporting the mask frame on the face panel; an electron gun for emitting an electron beam onto the phosphor screen through the plurality of apertures of the mask body; and a deflector for deflecting the electron beam emitted from the electron gun, and is wherein each of the four support members has first and second members each formed by bending a narrow long plate-like member having an elasticity, that the first member has an engagement portion engaged with the stud pin, that a first connection portion connected with the second member, and a first slanting portion slanted and extended from the first connection portion toward the engagement portion, in a direction in which the first member is apart from the second member, that the second member has a fixing portion fixed to the mask frame, a second connection portion connected with the first connection portion of the first member, and a second slanting portion slanted and extended from the second connection portion toward the fixing portion, in a direction in which the second member is apart from the first member, that the first member has a plate-thickness d1 smaller than a plate-thickness d2 of the second member and the first slanting portion has a length L1 smaller than a length L2 of the second slanting portion, that an angle $\theta 1$ between the first slanting portion of the first member and the engagement portion is larger than an angle $\theta 2$ between the second slanting portion of the second member and the fixing portion, and that an angle $\phi 1$ of the first slanting portion to a tube axis of the cathode ray tube is larger than an angle $\phi 2$ of the second slanting portion to the tube axis.

According to claim 7 of the present invention, the cathode ray tube according is wherein the length L1 and the angle $\phi 1$ of the first slanting portion and the length L2 and the angle $\phi 2$ of the second slanting portion satisfy a relation of $L1 \times \cos\phi 1 < L2 \times \cos\phi 2$.

According to claim 8 of the present invention, the cathode ray tube is wherein the first connection portion of the first member is extended in a direction in which the first slanting portion is extended.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

In the following, embodiments of the present invention will be specifically explained with reference to the drawings.

Figure 1:
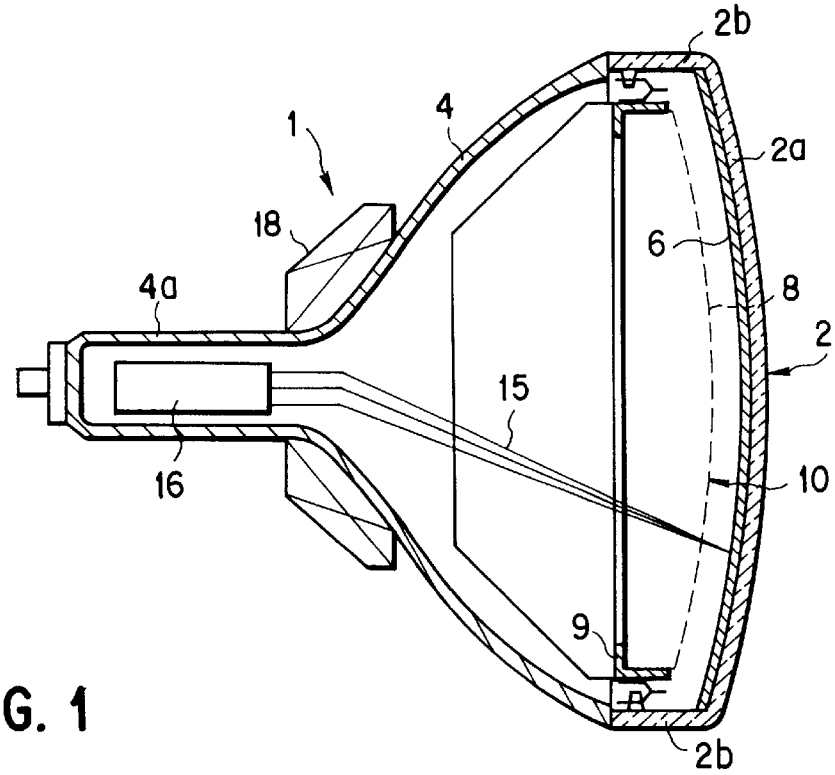
FIG. 1 is a cross-sectional view showing a cathode ray tube according to an embodiment of the present invention.

As shown in FIG. 1, the cathode ray tube 1 according to the present invention comprises an envelope including a face panel 2 (which will be referred to as only a panel 2 hereinafter) having a skirt portion 2*b* provided and standing on the periphery of an effective surface 2*a* consisting of a curved surface, and a funnel 4 connected to the skirt portion 2*b* of the panel 2. A phosphor screen 6 and a shadow mask 10 are provided in the envelope, both located inside of the panel 2. More precisely, the screen 6 is positioned, facing the effective surface 2*a* of the panel 2. The screen 2 consists of a number of phosphor units each composed of a blue-emitting layer, a green-emitting layer and a red-emitting layer. The shadow mask 10 opposes the phosphor screen 6.

Figure 2:
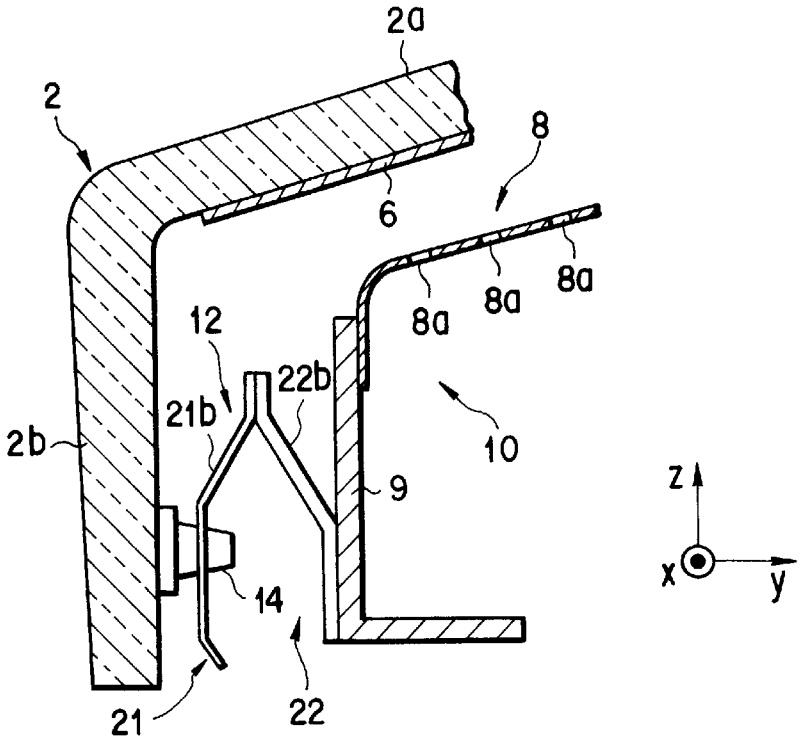
FIG. 2 is a partial cross-sectional view showing a support structure of a shadow mask in the cathode ray tube shown in FIG. 1.

As partially enlarged and shown in FIG. 2, the shadow mask 10 includes a mask body 8 formed by arranging a curved surface in a substantially rectangular shape, with a number of apertures 8*a* formed therein, and a substantially rectangular mask frame 9 provided at the periphery of the mask body 8. The mask frame 9 is formed to have a substantially L-shaped cross-section bent to the inside of the mask body 8. The mask body 8 is made of an invar material having a relatively low thermal expansion coefficient and a small plate-thickness, and the mask frame 9 is made of a carbon steel plate having a higher thermal expansion coefficient than the mask body 8.

Elastic support members 12 (which will be referred to as only holders 12 hereinafter) are respectively fixed outside the corner portions of the mask frame 9. The holders 12 are respectively engaged detachably on stud pins 14 provided inside the corner portions of the skirt portion 2*b*. The shadow mask 10 are suspended on the skirt portion 2*b* of the panel 2 by the four holders 12.

Meanwhile, an electron gun 16 for emitting three electron beams 15 is provided in an elongated neck 4*a* of the funnel 4. A deflector 18 which generates a magnetic field for deflecting the three electron beams 15 emitted from the electron gun 16 is provided outside the funnel 4.

The three electron beams 15 emitted from the electron gun 16 are deflected by the magnetic field generated from the deflector 18 and are applied onto the phosphor screen 6 through the apertures 8*a* of the shadow mask 10. In this manner, the phosphor screen 6 is scanned in the horizontal and vertical directions by the electron beams 15, and a color image is displayed through the phosphor screen 6.

In this time, to display an image of an excellent quality without a color drift on the phosphor screen 6 of the cathode ray tube 1, three electron beams 15 which have passed through electron beam apertures 8*a* must correctly land on three-color phosphor layers of the phosphor screen 6, respectively. For this purpose, the positional relationship between the panel 2 and the shadow mask 10 must be maintained correctly. In particular, the positional relationship therebetween must be maintained with high precision in consideration of reducing the pitch of the phosphor screen 6 to raise the resolution.

In other words, landing positions of the electron beams 15 are misregistered thereby causing electron beam landing misregistration, if the positional relationship between the panel 2 and the shadow mask 10 cannot be maintained with high precision. A thermal expansion of the mask frame 9, an impact applied from the outside of the cathode ray tube, or the like is considered as one of main factors which cause such misregistered landing.

The mask frame 9 is thermally expanded by a heat transferred from the mask body 8 heated by collisions of electron beams 15. That is, only ⅓ or less of the total electron beams emitted from the electron gun 16 pass through the electron beam apertures 8*a* of the mask body 8 and reach the phosphor screen 6. The rest of the electron beams collide into the mask body 8. Therefore, if the cathode ray tube 1 is operated for a long time, the mask frame 9 is heated and the mask body 8 is accordingly heated, so that the mask frame 9 is thermally expanded.

In case of using a shadow mask 10 having a mask body 8 made of invar material having a relatively low thermal expansion coefficient, the mask body 8 is not substantially deformed even when the mask frame 9 is thermally expanded. However, in a cathode ray tube in which the deflection angle is relatively large, the shadow mask is moved toward the phosphor screen and misregistered landing occurs even when conventional holders as shown in FIG.

12 are used, if a thermal expansion occurs in the mask frame 9 as a result of operation for a long time.

Meanwhile, if an impact is applied from the outside of the cathode ray tube 1, the engagement of the holders 12 on the stud pins 14 is changed and the shadow mask 10 is moved undesirably, thereby causing misregistered landing of electron beams.

From the grounds as described above, it is indispensable to reduce misregistered landing due to the thermal expansion of the mask frame 9 and misregistered landing due to an external impact on the cathode ray tube 1, in order to display an image of excellent quality in high resolution.

Therefore, the present inventors have invented a holder capable of compensating simultaneously both the misregistered landing due to the thermal expansion of the mask frame 9 and the misregistered landing due to an external impact applied to the cathode ray tube 1, as a holder which elastically suspend the shadow mask 10 on the panel 2.

Figure 3A:
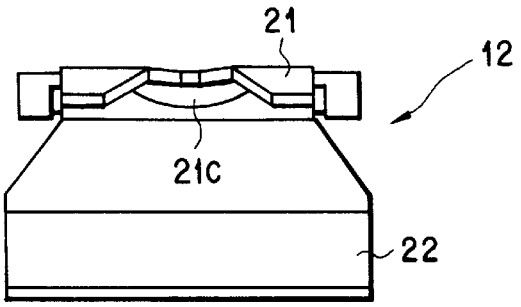
FIGS. 3A to 3C are views showing a holder according to a first embodiment of the present invention.
Figure 3B:
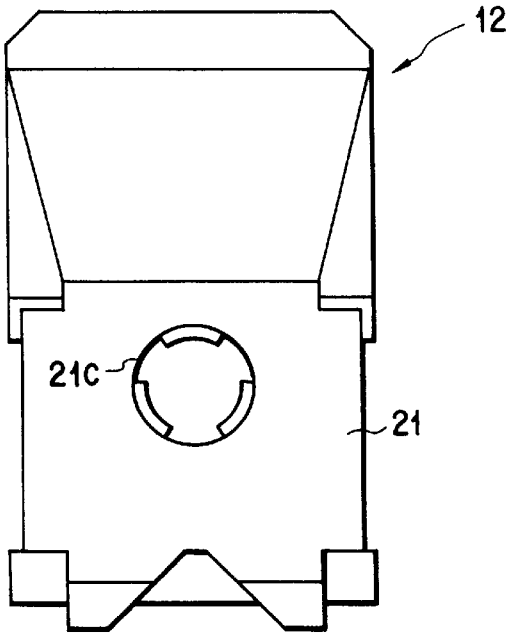
Figure 3C:
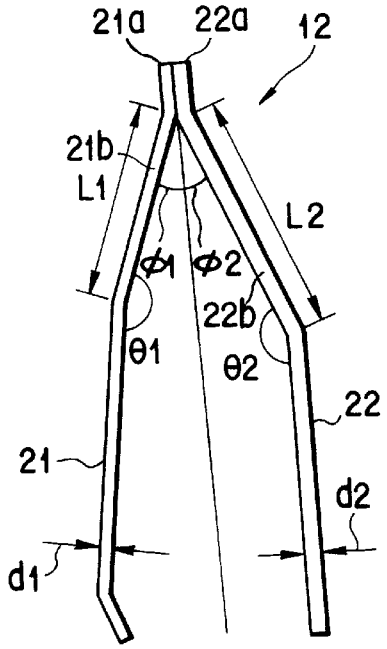

FIGS. 3A to 3C show a holder 12 according to the first embodiment of the present invention. FIG. 3A is a bottom view of the holder 12 viewed from the side of the electron gun 16. FIG. 3B is a side view of the holder 12 viewed from the side of the skirt portion 2*b* of the panel 2. FIG. 3C is a front view of the holder 12.

The holder 12 is comprised of a first member 21 having a substantially rectangular plate-like shape, and a second member 22 having a substantially rectangular plate-like shape. The first and second members 21 and 22 respectively have plate-thickness of d1 and d2. The first member 21 has an engagement portion where an engagement hole 21*c* is formed, and the engagement hole 21*c* is engaged with a stud pin 14. The second member 22 has a fixing portion to be fixed to the mask frame 9 of the shadow mask 10. The first and second members 21 and 22 respectively have ends 21*a* and 22*a* which are joined together by a predetermined length, and the members 21 and 22 are bent at the end of the joining portion, in a direction in which the member are apart from each other, thereby making the holder 12 substantially V-shaped.

The first member 21 is further bent toward the second member 22 at a position distant from the end of the joining portion by a length L1. Also, this first member 21 is slightly bent toward the second member 22 at a portion close to the other end which is apart from the end 21*a* of the member 21.

The second member 22 is bent toward the first member 21 at a position distant from the end of the joining portion by a length L2. Thus, the first and second members 21 and 22 respectively have slanting portions 21*b* and 22*b* having lengths L1 and L2, and are also respectively bent at angles θ1 and θ2 at the ends of the slanting portions, in the direction in which both members are closer to each other.

Under a condition in which the holder 12 is properly attached between the mask frame 9 and the skirt portion 2*b* (e.g., the condition shown in FIG. 2), the slanting portion 21*b* of the first member 21 is slanted at an angle ϕ1 to the direction parallel to the tube axis of the cathode ray tube 1 (in the direction z shown in the FIG. 2), and the slanting portion 22*b* of the second member 22 is slanted at an angle ϕ2.

The misregistered landing caused by a thermal expansion of the mask frame 9 and the misregistered landing caused by an impact from the outside of the cathode ray tube 1, i.e., the misregistration of the landing positions of the electron beams 15 caused by an undesirable movement of the shadow mask 10 are thus compensated by the function of the holders 12. The compensation amount and the compensation direction depend on parameters such as the plate-thickness d1 and d2 of the first and second members 21 and 22, the lengths L1 and L2 of the slanting portions 21*b* and 22*b*, the bending angles ϕ1 and ϕ2, and the slanting angles ϕ1 and ϕ2. Note that the compensation direction of the shadow mask 10 due to the holders 12 is a minus direction toward the electron gun 16 in case of the cathode ray tube according to the present embodiment.

That is, the parameters of the holder 12 may have optimum values which minimize the misregistered landing, i.e., the misregistered landing can be minimized by setting optimum values in the parameters. To investigate the optimum values, the parameters were set to preset reference values at first, and the movement value of the landing position of an electron beam was then measured as a characteristic parameter while changing only particular parameters.

Measurements were made of a characteristic parameter obtained in the thermal equilibrium attained by a long operation of the tube 1, a characteristic parameter obtained when an impact is applied to the tube 1 in its axial direction and a characteristic parameter obtained when an impact is applied to the tube 1 in a direction perpendicular to the axis of the tube 1. The reference values of the parameters of the holder 12 were set to d1=0.6 mm, d2=0.8 mm, L1=15 mm, L2=15 mm, ϕ1=169°, ϕ2=163°, ϕ1=15°, and ϕ2=15°. Further, in the graphs, the movement amount of the landing position of the electron beam is an average of movement amounts at respective portions of the shadow mask 10. The measurement results in this time are shown in the graphs of FIGS. 4 to 9.

Figure 4:
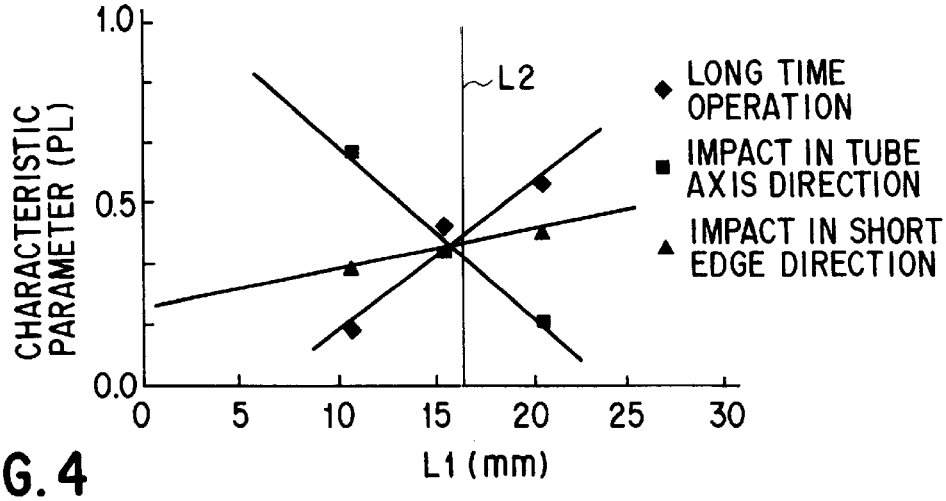
FIG. 4 is a graph showing a landing misregistration amount when the length L1 of the first slanting portion of the holder is changed.
Figure 5:
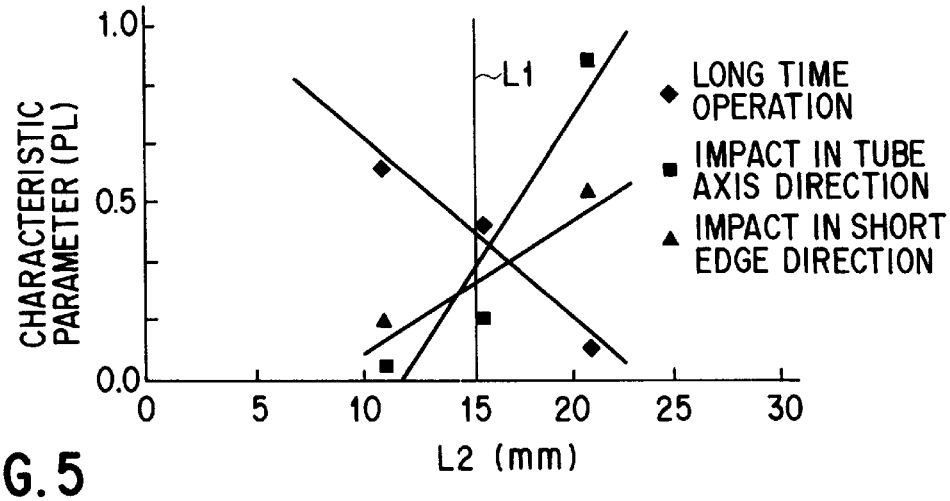
FIG. 5 is a graph showing a landing misregistration amount when the length L2 of the second slanting portion of the holder is changed.
Figure 6:
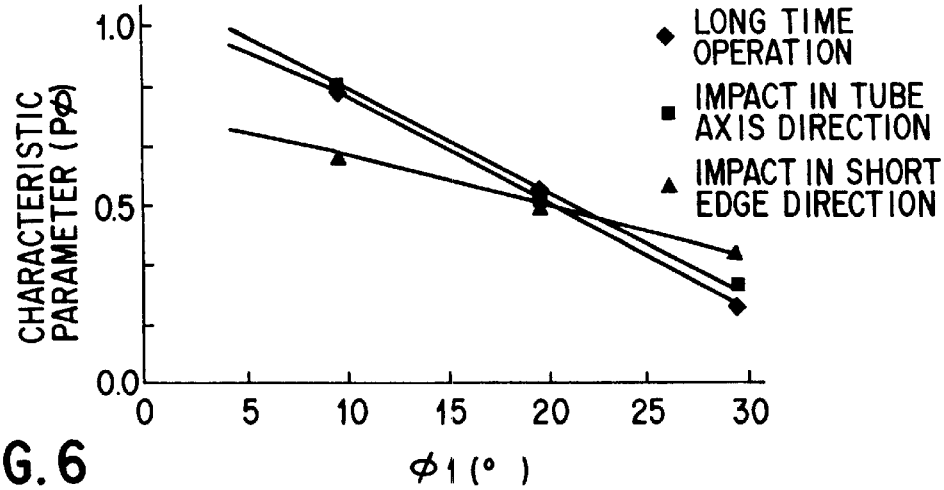
FIG. 6 is a graph showing a landing misregistration amount when the slanting angle $\phi$1 of the first slanting portion of the holder is changed.
Figure 7:
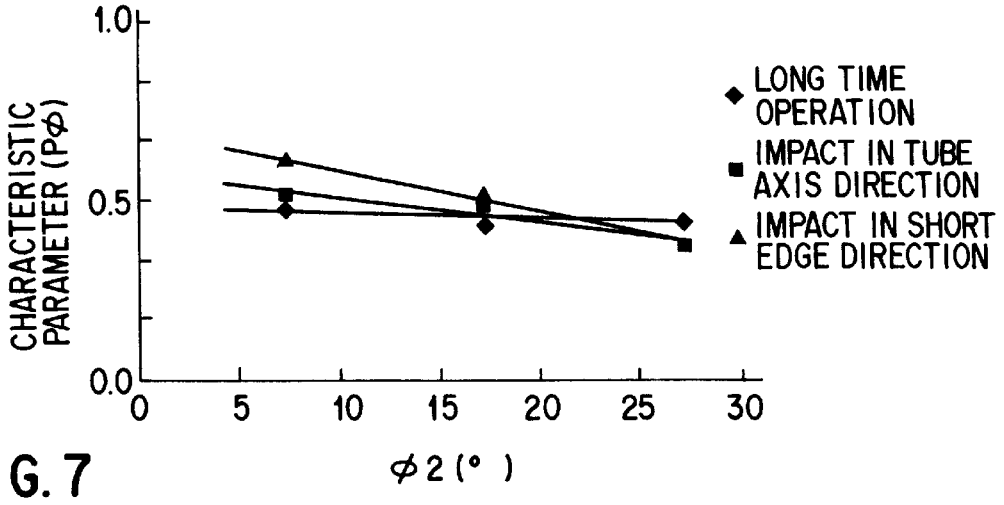
FIG. 7 is a graph showing a landing misregistration amount when the slanting angle $\phi$2 of the second slanting portion of the holder is changed.
Figure 8:
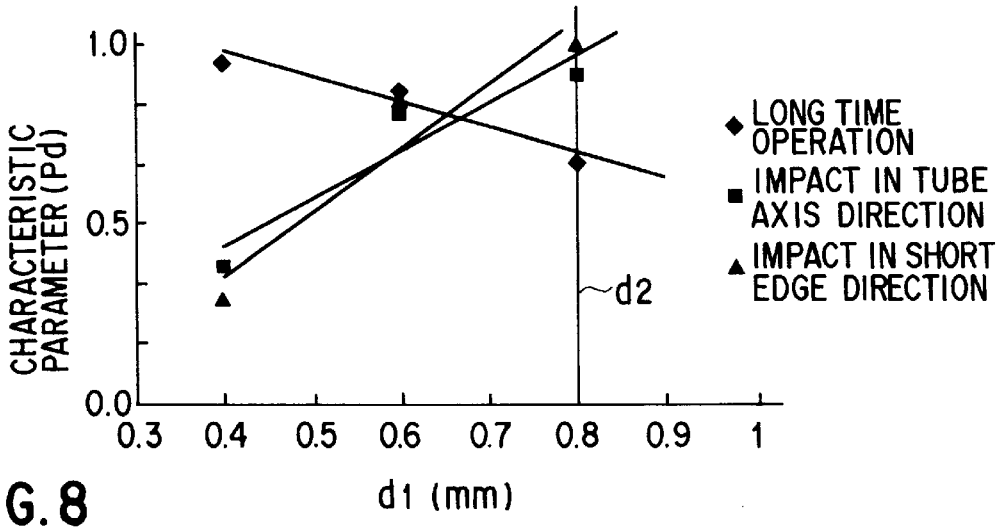
FIG. 8 is a graph showing a landing misregistration amount when the plate-thickness d1 of the first member of the holder is changed.
Figure 9:
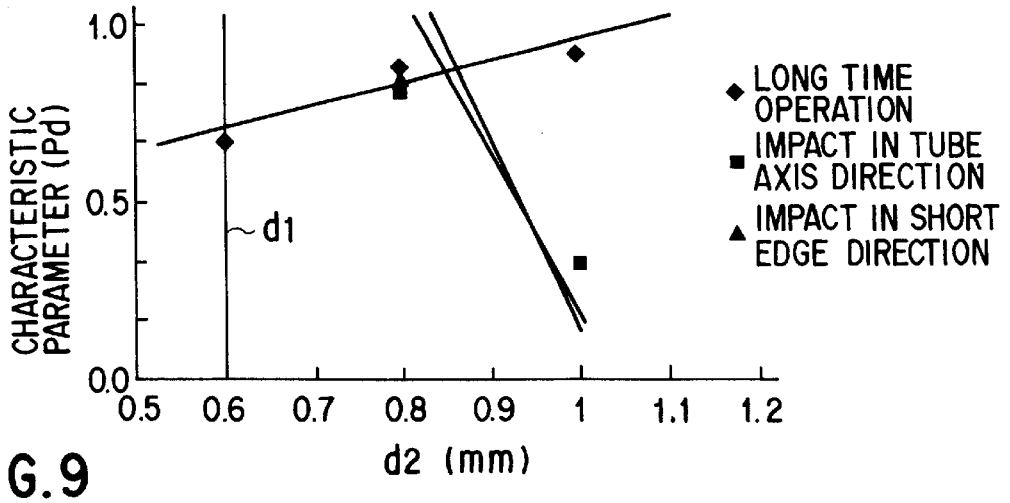
FIG. 9 is a graph showing a landing misregistration amount when the plate-thickness d2 of the second member of the holder is changed.

FIG. 4 shows changes of the characteristic parameter (PL) when only the length L1 of the slanting portion 21*b* of the first member 21 is changed. FIG. 5 shows changes of the characteristic parameter (PL) when only the length L2 of the slanting portion 22*b* of the second member 22 is changed. FIG. 6 shows changes of the characteristic parameter (Pϕ) when only the slanting angle ϕ1 of the slanting portion 21*b* is changed. FIG. 7 shows changes of the characteristic parameter (Pϕ) when only the slanting angle ϕ2 of the slanting portion 22*b* is changed. FIG. 8 shows changes of the characteristic parameter (Pd) when only the plate-thickness d1 of the first member 21 is changed. FIG. 9 shows changes of the characteristic parameter (Pd) when only the plate-thickness d2 of the second member 22 is changed. In each graph, the smaller the movement amount of the landing position is, i.e., the smaller the characteristic parameter is, the smaller the misregistered landing can be.

As can be seen from FIGS. 4, 5, 8, and 9, the characteristic parameter during operation for a long time tends to be repulsive to the characteristic parameters when external impacts (e.g., an impact in the tube axis direction and an impact in the short edge direction), where the lengths L1 and L2 of the slanting portions 21*b* and 22*b* of the holder 12 are changed, and when the plate-thickness d1 and d2 of the members 21 and 22 are changed. Therefore, to reduce the movement of the landing position of the electron beam caused by a thermal expansion of the mask frame during operation for a long time while restricting also the movement of the landing position of the electron beam caused by external impacts, it is desirable that the lengths L1 and L2 of the slanting portions and the plate-thickness d1 and d2 are set to values close to the cross points in the figures. From the values close to the cross points in the graphs, it is known that relations of L1<L2 and d1<d2 exist. Therefore, misregistered landing can be reduced by setting respective parameters so as to satisfy the relations of L1<L2 and d1<d2.

Meanwhile, as can be seen from FIGS. 6 and 7, the misregistered landing caused by operation for a long time and that caused by an external impact can be reduced by enlarging both the slanting angles $\phi 1$ and $\phi 2$ of the slanting portions 21*b* and 22*b* to the tube axis of the cathode ray tube 1. However, if the slanting angles $\phi 1$ and $\phi 2$ are too large, it hinders the detachability of the holder 12. In addition, there are limitations to the size of the holder 12, so that $\phi 1+\phi 2$ is restricted in accordance with the distance between the stud pin 14 and the mask frame 9.

From comparison between the FIGS. 6 and 7, it can be seen that the ratio of the change of the landing position of the electron beam, i.e., the inclination of the characteristic line is greater when $\phi 1$ is changed than when $\phi 2$ is changed. Therefore, misregistered landing can be reduced more when $\phi 1$ is changed prior to $\phi 1$. In consideration of these respects, the slanting angles of the slanting portions 21*b* and 22*b* should preferably be set so as to satisfy the relation of $\phi 1>\phi 2$.

In addition, since the fixing portion where the second member 22 is fixed to the mask frame 9 is parallel to the tube axis of the cathode ray tube 1, the engagement portion with the stud pin 14 of the first member 21 needs to be inclined to the tube axis in order to obtain a spring pressure enough to engage the shadow mask 10. Therefore, the bending angle should desirably set so as to satisfy $\theta 1>\theta 2$.

Thus, by setting respective parameters of the holder 12 so as to satisfy the relations of $L1<L2$, $d1<d2$, $\phi 1>\phi 2$, and $\phi 1>\phi 2$, the misregistered landing caused by a thermal expansion of the mask frame 9 and the misregistered landing caused by an external impact can simultaneously be compensated so that an image of high quality without a color drift can be displayed stably.

For example, where the sizes of the first and second members 21 and 22 of the holder 12 were set to $L1=15.6$ mm, $\phi 1=19.52°$, $\theta 1=169.0°$, $d1=0.6$ mm, $L2=16.11$ mm, $\phi 2=17.35°$, $\theta 2=162.6°$, and $d2=0.8$ mm, the movement amount of the landing position of the electron beam was improved as follows in comparison with a conventional holder (having $d1=0.5$ mm, $d2=0.8$ mm, and $L1>L2$ for reference). That is, the distance the beam-landing position moved in the long operation of the tube 1 was reduced from +44 $\mu$m to +24 $\mu$m and improved by about 45% on average for the entire surface of the mask 10; the distance the beam-landing position moved due to the externally applied impact was decreased from 17 $\mu$m to 14 $\mu$m and improved by about 18% on average for the peripheral part of the mask 10, and decreased from 50 $\mu$m to 37 $\mu$m and improved by 26% at maximum. In this example, the lengths L1 and L2 of the slanting portions 21*b* and 22*b* of the holder 12 and the slanting angles $\phi 1$ and $\phi 2$ thereof with respect to the tube axis satisfied a relation of $L1\times\cos\phi 1<L2\times\cos\phi 2$. It has been found that the movement amount of the landing position of the electron beam can be reduced more and misregistered landing can be reduced where the relation exists.

Figure 10A:
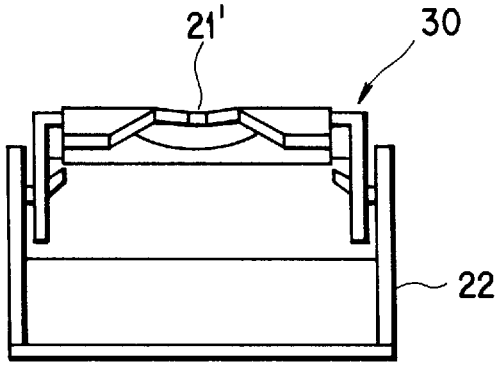
FIGS. 10A to 10C are views showing a holder according to a second embodiment of the present invention.
Figure 10B:
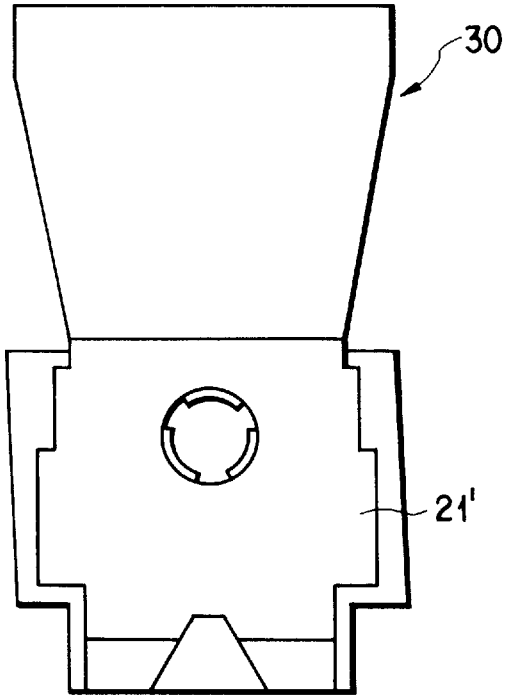
Figure 10C:
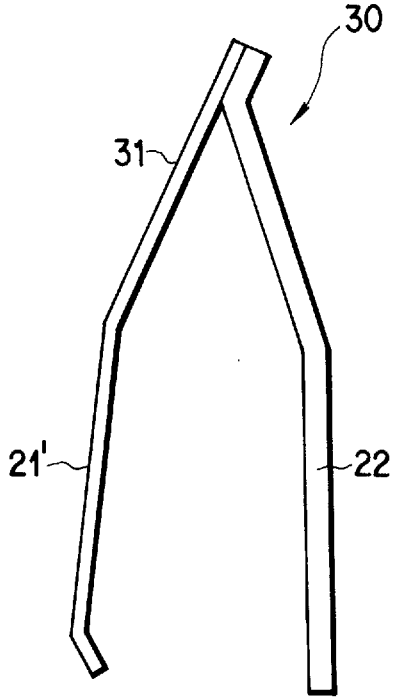
Figure 11:
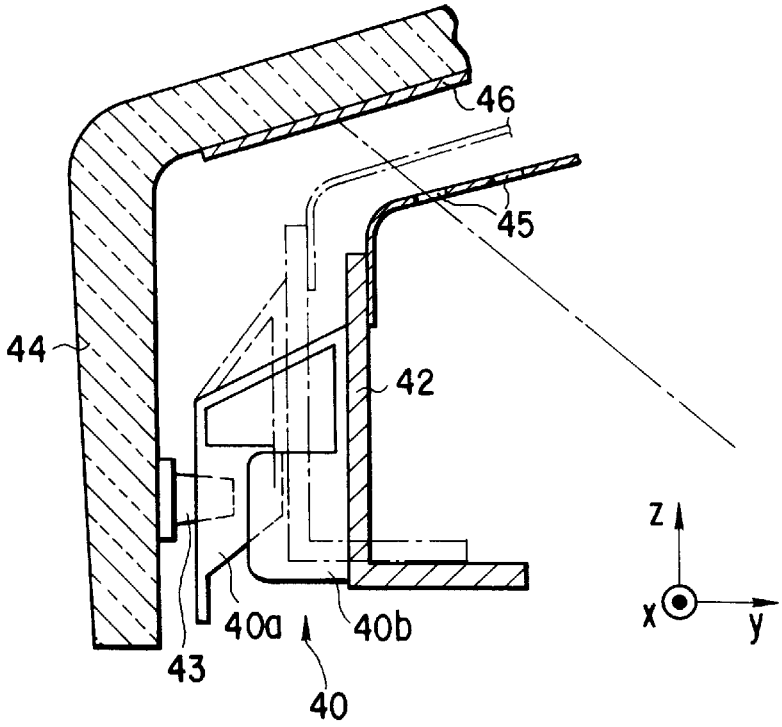
FIG.11 (PRIOR ART)
FIG. 11 is a cross-sectional view showing a conventional holder.
Figure 12:
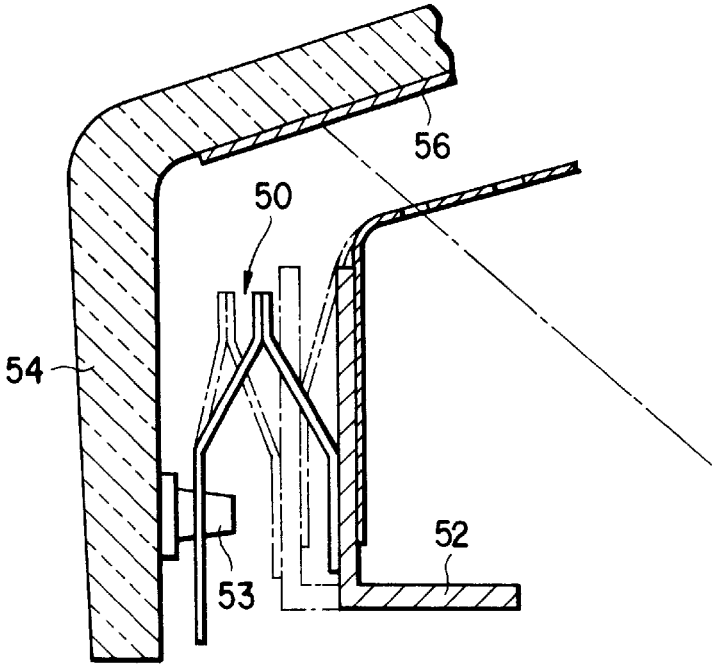
FIG.12 (PRIOR ART)
FIG. 12 is a cross-sectional view showing a conventional holder.

The present invention is not limited to the embodiment described above, but can be variously modified within the scope of the invention. For example, FIGS. 10A to 10C show a holder 30 according to a second embodiment of the present invention.

The holder 30 has rectangular plate-like first and second members 21' and 22. The joining portion where the first member 21' is joined together with the second member 22 is arranged to extend in the direction in which the slanting portion 31 extends. Thus, the detachment of the holder 30 can be more facilitated if the joining portion of the first member is shaped in form an extension of the slanting portion 31.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A cathode ray tube comprising:

a face panel having a substantially rectangular effective portion, a side wall portion standing along a peripheral edge portion of the effective portion, and a plurality of stud pins projected from an inner surface of the side wall portion;

a phosphor screen formed on an inner surface of the effective portion of the face panel;

a shadow mask having a substantially rectangular mask body and a substantially rectangular mask frame, the mask body being provided inside the face panel and having a plurality of apertures opposed to the phosphor screen, and the mask frame supporting a peripheral edge portion of the mask body and opposed to the side wall portion of the face panel;

a plurality of support members fixed to the mask frame and respectively engaged with the stud pins of the face panel, thereby elastically supporting the mask frame on the face panel;

an electron gun for emitting an electron beam onto the phosphor screen through the plurality of apertures of the mask body; and a deflector for deflecting the electron beam emitted from the electron gun, wherein each of the support members has first and second members each formed by bending a narrow long plate-like member having an elasticity, the first member has an engagement portion engaged with the stud pin, a first connection portion connected with the second member, and a first slanting portion slanted and extended from the first connection portion toward the engagement portion, in a direction in which the first member is apart from the second member, the second member has a fixing portion fixed to the mask frame, a second connection portion connected with the first connection portion of the first member, and a second slanting portion slanted and extended from the second connection portion toward the fixing portion, in a direction in which the second member is apart from the first member, and the first member has a plate-thickness d1 smaller than a plate-thickness d2 of the second member, and the first slanting portion has a length L1 smaller than a length L2 of the second slanting portion.

2. A cathode ray tube according to claim 1, wherein an angle $\theta 1$ between the first slanting portion of the first member and the engagement portion is larger than an angle $\theta 2$ between the second slanting portion of the second member and the fixing portion.

3. A cathode ray tube according to claim 1, wherein an angle $\phi 1$ of the first slanting portion to a tube axis of the cathode ray tube is larger than an angle $\phi 2$ of the second slanting portion to the tube axis.

4. A cathode ray tube according to claim 3, wherein the length L1 and the angle $\phi 1$ of the first slanting portion and the length L2 and the angle $\phi 2$ of the second slanting portion satisfy a relation of $L1 \times \cos\phi 1 < L2 \times \cos\phi 2$.

5. A cathode ray tube according to claim 1, wherein the first connection portion of the first member is extended in a direction in which the first slanting portion is extended.

6. A cathode ray tube comprising:

a face panel having a substantially rectangular effective portion, a side wall portion standing along a peripheral edge portion of the effective portion, and four stud pins provided to be projected from inner surfaces of four corner portions of the side wall portion;

a phosphor screen formed on an inner surface of the effective portion of the face panel;

a shadow mask having a substantially rectangular mask body and a substantially rectangular mask frame, the mask body being provided inside the face panel and having a plurality of apertures opposed to the phosphor screen, and the mask frame supporting a peripheral edge portion of the mask body, being opposed to the side wall portion of the face panel, and having a higher thermal expansion coefficient than the mask body;

four support members respectively fixed to four corner portions of the mask frame and respectively engaged with the four stud pins of the face panel, thereby elastically supporting the mask frame on the face panel;

an electron gun for emitting an electron beam onto the phosphor screen through the plurality of apertures of the mask body; and a deflector for deflecting the electron beam emitted from the electron gun, wherein each of the four support members has first and second members each formed by bending a narrow long plate-like member having an elasticity, the first member has an engagement portion engaged with the stud pin, a first connection portion connected with the second member, and a first slanting portion slanted and extended from the first connection portion toward the engagement portion, in a direction in which the first member is apart from the second member, the second member has a fixing portion fixed to the mask frame, a second connection portion connected with the first connection portion of the first member, and a second slanting portion slanted and extended from the second connection portion toward the fixing portion, in a direction in which the second member is apart from the first member, the first member has a plate-thickness d1 smaller than a plate-thickness d2 of the second member, and the first slanting portion has a length L1 smaller than a length L2 of the second slanting portion, an angle $\theta 1$ between the first slanting portion of the first member and the engagement portion is larger than an angle $\theta 2$ between the second slanting portion of the second member and the fixing portion, and an angle $\phi 1$ of the first slanting portion to a tube axis of the cathode ray tube is larger than an angle $\phi 2$ of the second slanting portion to the tube axis.

7. A cathode ray tube according to claim 6, wherein the length L1 and the angle $\phi 1$ of the first slanting portion and the length L2 and the angle $\phi 2$ of the second slanting portion satisfy a relation of $L1 \times \cos\phi 1 < L2 \times \cos\phi 2$.

8. A cathode ray tube according to claim 6, wherein the first connection portion of the first member is extended in a direction in which the first slanting portion is extended.

* * * * *